United States Patent [19]

Tanaka

[11] Patent Number: 4,468,662

[45] Date of Patent: Aug. 28, 1984

[54] DISPLAY APPARATUS FOR DISPLAYING CHARACTERS OR GRAPHICS ON A CATHODE RAY TUBE

[75] Inventor: Kazuyuki Tanaka, Kamakura, Japan

[73] Assignee: Matsushita Electric Industrial Co., Ltd., Kadoma, Japan

[21] Appl. No.: 331,871

[22] Filed: Dec. 17, 1981

[30] Foreign Application Priority Data

Dec. 24, 1980 [JP] Japan ..... 55-184283

[51] Int. Cl.[3] ..... G09G 1/00

[52] U.S. Cl. ..... 340/789; 340/749; 340/750; 340/799

[58] Field of Search ..... 340/789, 799, 800, 732, 340/733, 749, 750

[56] References Cited

U.S. PATENT DOCUMENTS 3,803,584 4/1974 Hittel ..... 340/799

4,388,621 6/1983 Konatsu et al. ..... 340/750

*Primary Examiner*—Gerald L. Brigance

*Attorney, Agent, or Firm*—Stevens, Davis, Miller & Mosher

[57] ABSTRACT

A display apparatus is disclosed comprising a picture memory having memorizing portions which correspond in one-to-one relation to characters or graphics to be displayed on the screen of a cathode ray tube display monitor, a CPU of a controller for reading or writing the picture memory, and a CRT controller for generating timing signals which are used for displaying on the screen of the cathode ray tube display monitor. Data are read from the picture memory by the timing signals which the CRT controller generates and displayed on the cathode ray tube display monitor, wherein the frequency of operation clock signals of the CPU in the period in which the picture memory is read or written and that in the period in which the picture memory is neither read nor written are made different, so that the CPU can operate at high speed.

2 Claims, 9 Drawing Figures

DISPLAY APPARATUS FOR DISPLAYING CHARACTERS OR GRAPHICS ON A CATHODE RAY TUBE

This invention relates to a display apparatus having a cathode ray display tube.

It is an object of the invention to provide a display apparatus having a picture memory which has memorizing portions which correspond in one-to-one relation to characters or a graphics to be displayed on the screen of a raster scan type cathode ray tube (hereinafter, referred to as a CRT), a CPU (central processing unit) as a controller for reading and writing the picture memory, and a CRT controller for generating timing signals for display of pictures on the CRT screen, the CRT controller reading out data from the picture memory using the timing signals which the CRT controller generates, the read out data being converted into bits by a character generator and then converted from parallel form into serial form as a signal to be displayed on the CRT screen, wherein the frequency of operating clocks of the CPU in the period in which the picture memory is read or written and that in the period in which the picture memory is neither read nor written are made different, making it possible for the CPU to operate at high speed.

The invention will become more readily understood from the following exemplary description referring to the accompanying drawings in which.

In the conventional arrangement of FIG. 1, the reading and writing operation of CPU1 on a picture memory 2 is not in synchronism with the operation for a CRT controller 3 to read data from the picture memory 2 as will be described with reference to FIG. 2.

Figure 1:
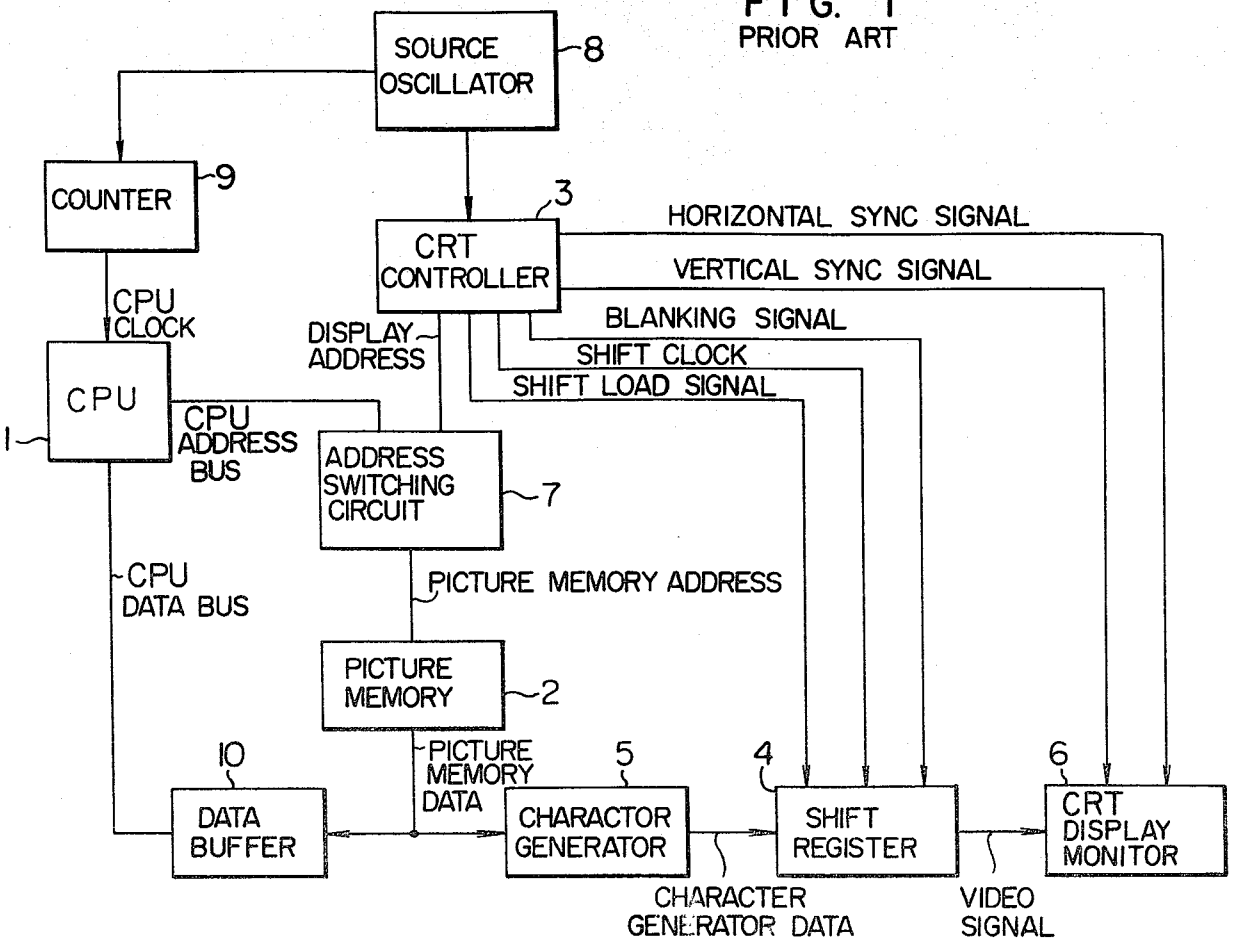
FIG. 1 PRIOR ART
FIG. 1 is a block diagram of a conventional display apparatus.
Figure 2:
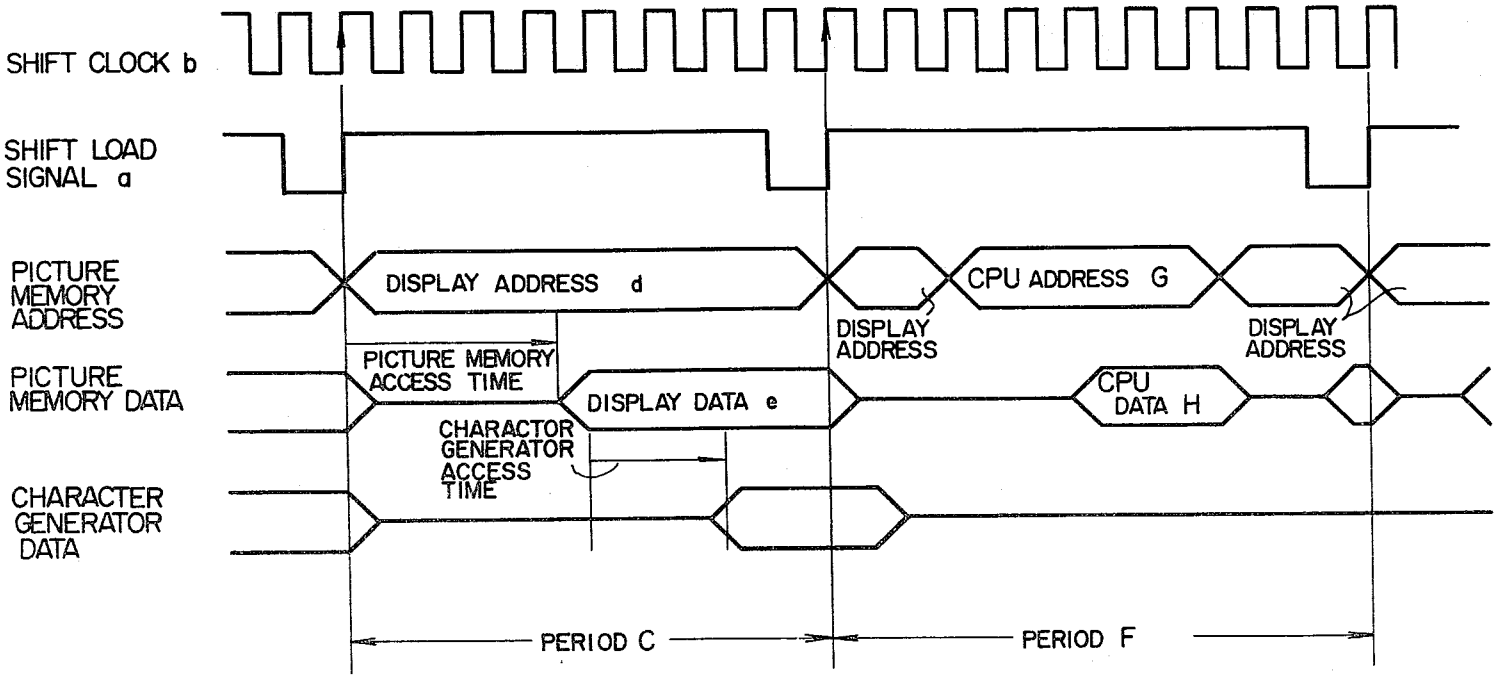
FIG. 2 is a timing chart for the block diagram of FIG. 1.

First, a shift register 4 in FIG. 1 stores data to be displayed from a character generator 5 at the low level of a shift load signal a as shown in FIG. 2. Then, at the timing of a shift clock b, the data to be displayed is converted from parallel data into serial data, which is applied to a CRT display monitor 6 as a signal to be displayed thereon. In a period C as shown in FIG. 2, the CRT controller 3 supplies a display address d corresponding to a position on the CRT at which data is to be displayed, through an address switching circuit 7 to the picture memory 2, and a data e to be displayed at the address d is applied to the character generator 5 as a code for a character to be displayed. The character generator 5 supplies a series of bits constituting a character corresponding to the character code to the shift register 4.

Figure 3:
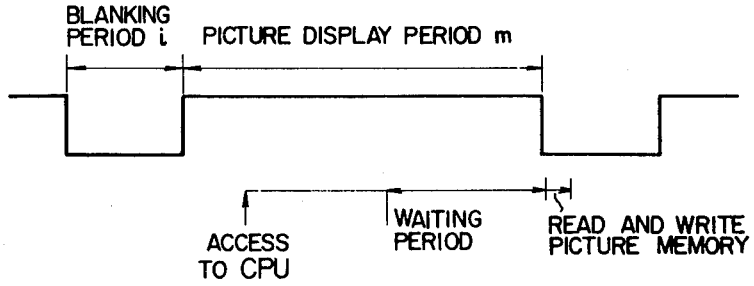
FIG. 3 is a timing chart for the case in which the CPU reads and writes the picture memory during a blanking period in a conventional example for improving the defect of the arrangement of FIG. 1.

In a period F as shown in FIG. 2, when the CRT controller 3 is going to or operating to begin to read data from the picture memory 2, the CPU1 reads and writes the memory 2. First, the address switching circuit 7 changes to address a CPU address G from addressing of the display address d of the CRT controller 3 and supplies it to the picture memory 2. At this time, reading or writing of a CPU data H to the CPU address G by the CPU1 is carried out between the CPU1 and the picture memory 2 through a data buffer 10. As will be understood from FIG. 2, a correct data e corresponding to the character to be displayed may not be obtained because in the period F the CPU1 reads or writes the picture memory 2 and accordingly a character which is different from the character to be displayed may be momentarily displayed, and this may appear to be like a kind of noise. In order to remove such drawbacks, the following methods have been used conventionally:

(1) The CPU1 reads and writes the picture memory 2 in a blanking period i as shown in FIG. 3.

Figure 4:
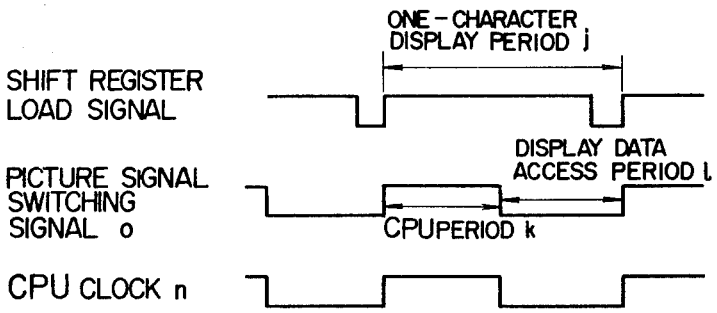
FIG. 4 is a timing chart for the case in which the one-character display period is divided into the CPU period and the CRT controller period in another conventional improvement.

(2) As shown in FIG. 4, one-character display period j is divided into a period k in which the CPU1 reads or writes the picture memory 2 and a period l in which the CRT controller 3 reads out data from the picture memory 2, and the clock for the division is used as the operating clocks of the CPU1.

In the method (1), however, when the CPU1 operates to read or write the picture memory 2 during a picture display period m as shown in FIG. 3, it is necessary for the CPU1 to delay its operation until the next blanking period i, therefore, the operating speed of the CPU1 is greatly reduced. In the method (2), since the one-character display period j in FIG. 4 is divided and the CPU clock n is applied to the CPU1 in order to synchronize the operating clock to the CPU1 with the operating clock to the CRT controller 3, it is impossible to operate the CPU1 with any arbitrary CPU clock.

This invention is designed to remove the above discussed drawbacks in prior art, and this invention is characterized in that in the period in which the CPU reads and writes the picture memory the switching signal for picture display is used as the CPU clock to the CPU1, and in the period in which the CPU neither reads nor writes the picture memory a CPU clock which has a desired operating speed is applied to the CPU.

An embodiment of the present invention will hereinafter be described with reference to the accompanying drawings.

Figure 5:
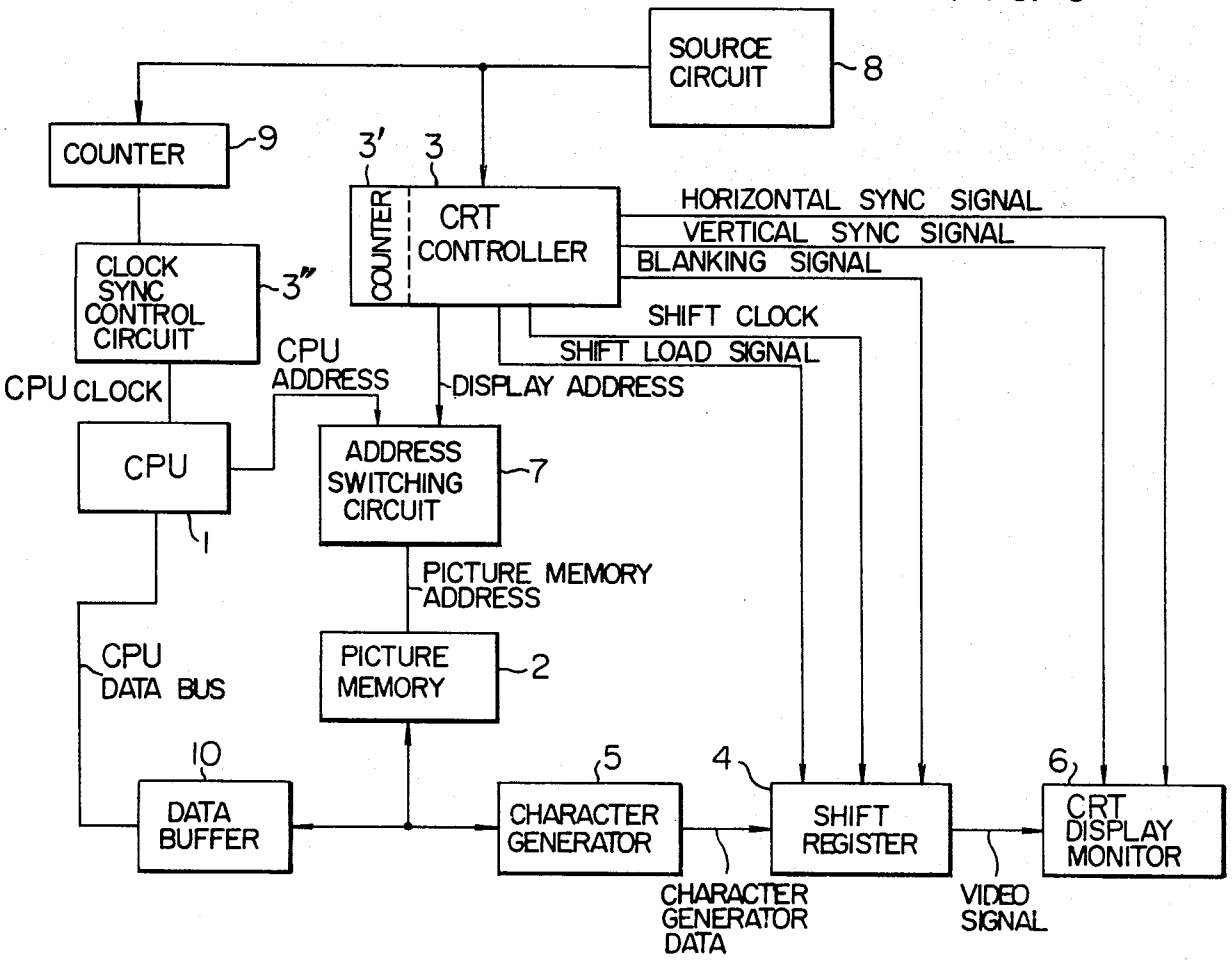
FIG. 5 is a block diagram of one embodiment of a display apparatus of the invention.
Figure 6:
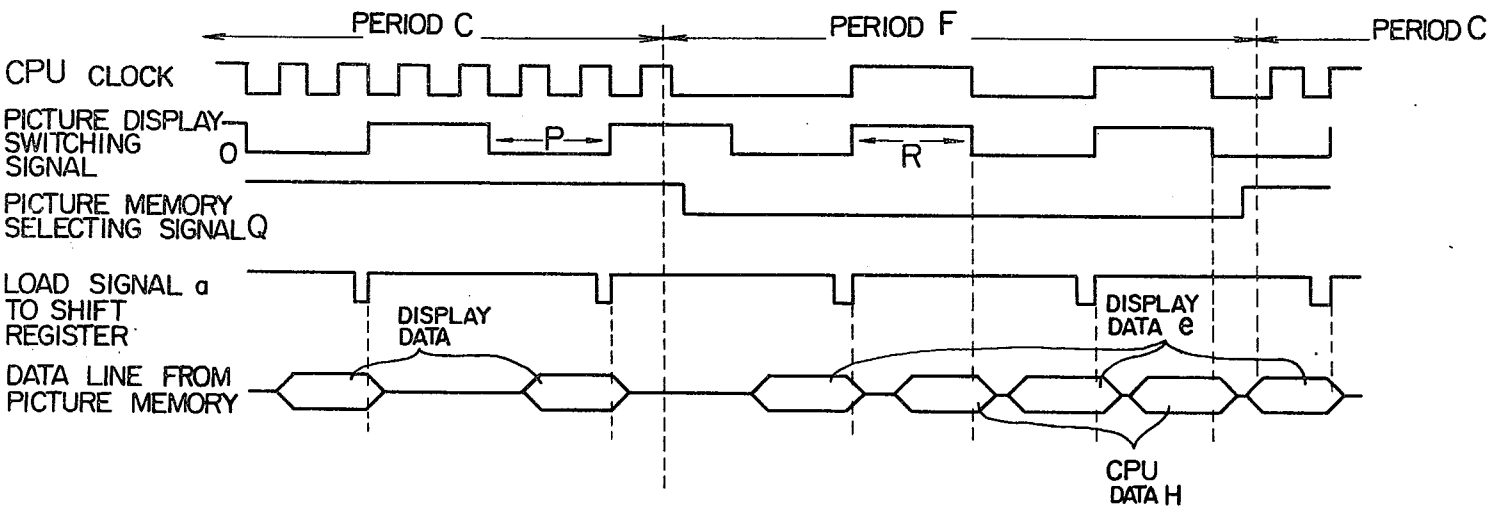
FIG. 6 is a timing chart useful for explaining the operation of the arrangement of FIG. 5.

FIG. 5 shows a block diagram of an embodiment of a display apparatus according to this invention, and FIG. 6 shows a timing chart to which reference is made in explaining the operation of the display apparatus as shown in FIG. 5.

Referring to FIG. 5, there are shown a CRT controller 3, a source oscillator 8, a counter 9, a picture memory 2, an address switching circuit 7, a CPU1, a data buffer 10, a character generator 5, a shift register 4, a CRT display monitor 6, a display clock signal generating circuit 3' belonging to the CRT controller 3, and a CPU clock synchronizing control circuit 3''.

The operation of this arrangement will be described as follows. First, an oscillation output signal generated from the source oscillator 8 is applied to the CRT controller 3 and counter 3', which then generate horizontal and vertical synchronizing signals to be supplied to the CRT display monitor 6, a blanking signal, shift clock, and shift load signal etc. to be applied to the shift register 4, and a display address to be applied to the picture memory 2. The display address generated from the CRT controller 3 is applied through the address switching circuit 7 to the picture memory 2 when a picture display switching signal O, as shown in FIG. 6, generated from the counter 3' is at low level during a period P. The picture memory 2 supplies display data located at the display address to the character generator 5, which then supplies to the shift register 4 a character bit series corresponding to the applied display data. The shift register 4 latches the series of bits of the character at low level of a shift register load signal a as shown in FIG. 6 and then converts the bit series of the character into a serial data at the timing of a shift clock. The serial data is applied to the CRT display 6 as a video signal, so that the character appears on the display screen.

During the period in which the CPU1 in FIG. 5 does not read or write the picture memory 2, the CPU operates at high speed in response to a high-frequency CPU clock as shown in FIG. 6 by a period C. However, when the CPU1 is going to read or write the picture memory 2, a picture memory selecting signal Q to the picture memory 2 generated from a decoder (not shown) for decoding the CPU address is applied to the clock synchronizing control circuit 3" and the address switching circuit 7. Thereby, the CPU clock to the CPU1 is controlled by the clock synchronizing control circuit 3" so that the CPU clock may be synchronized with the picture display switching signal O as shown in FIG. 6 by a period F. In the period F, the CPU address from the CPU1 is applied through the address switching circuit 7 to the picture memory 2 when the picture display switching signal O from the counter 3' is at high level during a period R. In the picture memory 2, a CPU data H is read from and is written in the location corresponding to the CPU address thus applied from the CPU1.

After the CPU1 completes the read or write operation on the picture memory 2, the CPU1 operates in response to the high frequency CPU clock as shown in FIG. 6 by period C.

In this way, when the CPU1 does not carry out any of reading or writing of the picture memory 2, the CPU1 can operate at high speed. Moreover, even when the CPU1 reads or writes the picture memory 2, the CPU1 is synchronized with the display timing, therefore, no flickers, noises or other interferences appear on the CRT display screen, and also since the CPU1 does not require unnecessary waiting time it is possible to read or write at high speed.

Figure 7:
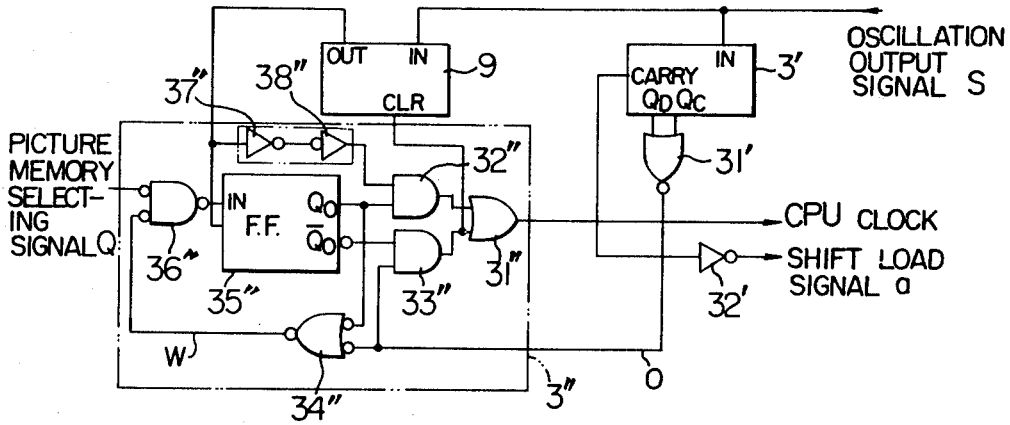
FIG. 7 is a circuit diagram of a specific example of a main part of FIG. 5.

Description will hereinafter be made of a specific example of a circuit arrangement including the clock synchronizing control circuit 3" and the counters 9 and 3' in FIG. 5. FIG. 7 shows this specific example of the circuit arrangement. Referring to FIG. 7, there are shown the 1/16-frequency diving counter 3' using, for example, 74 LS 161 and others, the 1/16-frequency diving counter 9 using, for example, 74 LS 92, a NOR gate 31', an OR gate 31", an AND gate 32", an AND gate 33", an AND gate 34", a D type flip-flop 35", an OR gate 36", inverters 37" and 38", and an inverter 32'.

Figure 8:
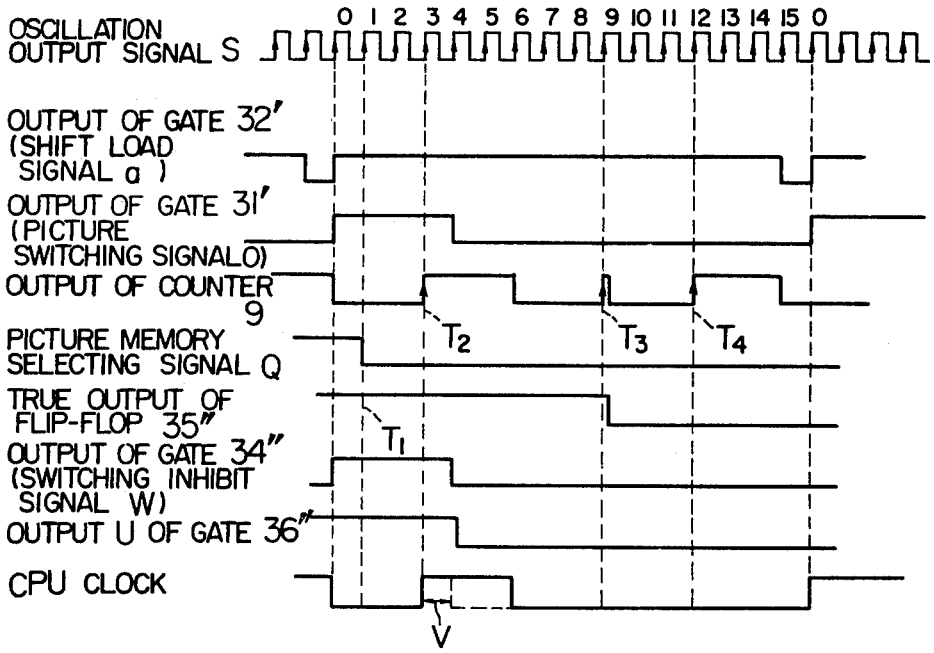
FIGS. 8 and 9 are timing charts useful for explaining the operation of the arrangement of FIG. 7.

The operation of this arrangement will be described with reference to the timing chart of FIG. 8 as follows. First, an oscillation output signal S from the source oscillator 8 is applied to and divided in its frequency by the counters 3' and 9. A shift load signal a as shown in FIG. 8 is the output from the inverter 32' to which one (carry signal) of the frequency-divided output signals from the counter 3' is applied. The shift load signal a is used as a load signal to the parallel-to-serial converting shift register 4. Then, a $\frac{1}{8}$-frequency divided signal $Q_D$ and a $\frac{1}{4}$-frequency divided signal $Q_C$ are applied to the NOR gate 31', the output of which is used as the picture switching signal O. The AND gate 34", when supplied with a low level from the true output ($Q_o$) of the flip-flop 35" or a low level from the output of the NOR gate 31', produces a low-level output, i.e., generates a switching inhibit signal W for CPU clock. When the CPU1 reads or writes the picture memory 2, the picture memory selecting signal Q as shown in FIG. 7 becomes a low level. The gate 36" functions as an AND gate (negative logic) to produce a low-level output, when the switching inhibit signal W and the picture memory selecting signal Q become a low level. The flip-flop 35" latches the output from the gate 36" at the leading edges of the output of the counter 9. The flip-flop 35" controls the switching circuit consisting of the gates 31", 32" and 33" so that when the true output of the flip-flop 35" is a high level, the output of the counter 9 is used as the CPU clock to the CPU1, and when the true output thereof is a low level, the output of the NOR gate 31' is used as the CPU clock. The inverters 37" and 38" are used for delay.

Operation of the above structure will be described. When the CPU1 reads or writes the picture memory 2, the picture memory selecting signal Q becomes a low level ($T_1$ in FIG. 8). On the other hand, the flip-flop 35" for storing the clock switching control signal stores the output signal U from the gate 36" at the leading edges ($T_2$) of the output of the counter 9. In FIG. 8, at $T_2$ the output signal U is a high level and thus no switching occurs.

If at the timing of $T_2$ the CPU clock has been switched to be supplied from the gate 31' by switching the outputs of the counter 9 and gate 31", the CPU clock waveform would become narrow in width as indicated by V in FIG. 8, and the frequency becomes too high and exceeds its maximum operating frequency.

Figure 9:
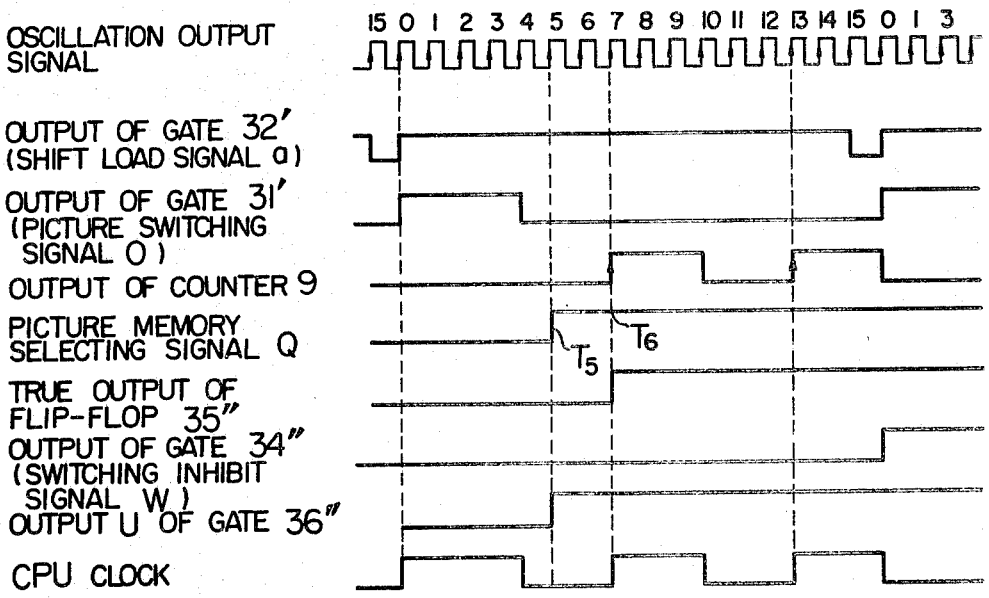

At the timing of $T_3$ the output signal U from the gate 36" has become a low level and thus the true output of the flip-flop 35" is a low level, or the false output ($\overline{Q}_o$) thereof is a high level. As a result, the output of the gate 31' is selected for the CPU clock to the CPU1. The timing at which the CPU1 completes reading or writing of the picture memory 2 will be described with reference to FIG. 9. At $T_5$ the CPU1 finishes the reading or writing of the picture memory 2. The flip-flop 35", at $T_6$, stores the output signal U from the gate 36" and produces a high level output at the true output. When the true output of the flip-flop 35" is a high level, the gates 32", 33" and 34" are controlled to select the output signal from the counter 9 by switching the outputs of the gate 31' and counter 9 and as a result the gate 31" supplies the output of the counter 9 as the CPU clock to the CPU1.

Thus, in the clock synchronizing control circuit in FIG. 7, the CPU clock to the CPU1 results from division of the frequency of the oscillation output signal S by six when the picture memory 2 is not read or written, or from diving it by 16 when the picture memory 2 is read or written. With the arrangement of FIG. 7, the CPU1 can be operated at a speed 2.66 times higher than in the case where the picture switching signal O is always selected as the CPU clock to the CPU1.

While one embodiment of this invention has been described as above, the circuit constructed with the gates 31' and 34" may be constructed with the combination of logic gates, for example, AND, NOT, OR gates and the like for logically gating the output signals from the counter 3' and flip-flop 35" in FIG. 7, at which time the same effect as in the above mentioned embodiment can of course be achieved.

The flip-flop 35" may be replaced by a device having a temporal storing function, such as an RS flip-flop, a J-K flip-flop, or a memory etc.

Moreover, the switching circuit formed of the gates 31", 32" and 33" may be replaced by another device having a switching function, such as a switch and a switching gate etc.

If there are provided a plurality of counters 9 and 3' it is possible to make the CPU1 operate at a plurality of frequencies. Also even when selecting the frequency dividing ratios of the counters to be any value, exactly the same effect can be expected.

What is claimed is:

1. A display apparatus for displaying characters or graphics on a cathode ray tube comprising:

a picture memory having memorizing portions which correspond in a one-to-one relation with characters or graphics to be displayed on the screen of the cathode ray tube;

a cathode ray tube controller for supplying a display address to the memory for addressing the memory associated with each of said memorizing portions;

a CPU for supplying a CPU address to the memory for addressing the memory in order to control reading and writing of said picture memory;

an address switching circuit for passing either of said display address or said CPU address to said picture memory under the control of a picture display switching signal;

a source oscillator for generating an oscillation output signal and for supplying it to the cathode ray tube controller;

a first counter for counting the oscillation output signal in order to generate a first CPU clock signal;

a second counter for counting the oscillation output signal in order to generate a second CPU clock signal, the frequency of said second CPU clock signal being higher than the frequency of said first CPU clock signal; and, a clock synchronizing control circuit for controlling and selecting one of said first and second CPU clock signals to be applied to the CPU in response to a picture memory selecting signal so that the first CPU clock signal is applied as a clocking signal to the CPU during the period when said CPU is reading to or writing from said picture memory, and the second CPU clock signal is applied as a clocking signal to the CPU during other periods.

2. A display apparatus for displaying characters or graphics on a cathode ray tube according to claim 1, wherein said clock synchronizing control circuit comprises:

a flipflop;

a first AND gate, the input signals to said first AND gate being the first CPU clock signal and a first output signal of said flipflop;

a first OR gate, input signals to said first OR gate being the output signal of said first AND gate and the picture memory selecting signal, and an output signal of said first OR gate being supplied to said flipflop;

a second AND gate, input signals to said second AND gate being the second CPU clock signal and the first output signal of the flipflop;

a third AND gate, input signals to said third AND gate being the first CPU clock signal and a second output signal of said flipflop; and, a second OR gate, input signals to said second OR gate being an output signal of said second AND gate and an output signal of said third AND gate, the output signal of said second OR gate being supplied to the CPU as said clocking signal.

* * * * *